US008338719B2

(12) United States Patent
Lehane et al.

(10) Patent No.: US 8,338,719 B2
(45) Date of Patent: Dec. 25, 2012

(54) DIRECTLY ELECTRIFIED CEILING GRID

(75) Inventors: James J. Lehane, McHenry, IL (US); Peder Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 555 days.

(21) Appl. No.: 12/621,915

(22) Filed: Nov. 19, 2009

(65) Prior Publication Data

US 2010/0139190 A1 Jun. 10, 2010

Related U.S. Application Data

(60) Provisional application No. 61/120,544, filed on Dec. 8, 2008.

(51) Int. Cl.
*H02B 1/40* (2006.01)
*E04C 2/52* (2006.01)
*E04B 9/18* (2006.01)

(52) U.S. Cl. ..... 174/480; 174/491; 52/220.6; 52/506.7

(58) Field of Classification Search ..... 174/480, 174/481, 491, 503, 50; 52/506.07, 506.06, 52/220.6, 220.1, 220.7, 220.8; 439/121, 439/535, 949; 220/3.2, 3.3, 4.02
See application file for complete search history.

(56) References Cited

U.S. PATENT DOCUMENTS 2,888,113 A * 5/1959 Schwartz et al. ..... 174/491
3,590,135 A * 6/1971 Herbenar et al. ..... 174/491
3,725,568 A * 4/1973 Stanley ..... 174/491
4,540,847 A * 9/1985 Gardner ..... 174/491
5,517,796 A 5/1996 Koski et al.
5,687,525 A 11/1997 Koski et al.
6,298,623 B1 * 10/2001 Wendt ..... 52/506.06
6,305,139 B1 10/2001 Sauer
6,523,313 B2 2/2003 Lin et al.
7,351,075 B1 * 4/2008 Patterson et al. ..... 439/121
7,428,801 B2 9/2008 Ostenfeldt
7,661,229 B2 * 2/2010 Frecska et al. ..... 52/220.6
7,679,222 B2 * 3/2010 Patterson et al. ..... 174/480
7,997,910 B2 * 8/2011 Myers et al. ..... 439/121
8,146,316 B2 * 4/2012 Boss et al. ..... 52/506.07

OTHER PUBLICATIONS

International Search Report, PCT/US2009/065030, dated Jul. 5, 2010.

* cited by examiner

*Primary Examiner* — Angel R Estrada
(74) *Attorney, Agent, or Firm* — Pearne & Gordon LLP

(57) ABSTRACT

An electrified grid for a suspended ceiling comprising first and second grid sections lying in a common ceiling plane, each grid section having metal main tees and metal cross tees intersecting with the main tees, the first and second sections being adjacent one another and having respective main tees in parallel alignment and with a fixed spacing not substantially greater than the length of the cross tees, the grid sections being electrically insulated from one another whereby at least said main tees of fixed spacing can be held at opposite voltage polarities and an electrical device carried on or above the ceiling can be powered by electrical connection of separate ones of its leads to the metal tees of a respective one of said first and second grid sections.

8 Claims, 2 Drawing Sheets

DIRECTLY ELECTRIFIED CEILING GRID

This application claims the priority of U.S. Provisional Application No. 61/120,544, filed Dec. 8, 2008.

BACKGROUND OF THE INVENTION

The invention relates to suspended ceiling structures and, in particular, to electrification of such ceiling structures.

PRIOR ART

Commercial building spaces such as offices, laboratories, light manufacturing facilities, health facilities, meeting and banquet hall facilities, educational facilities, common areas in hotels, apartments, retirement homes, retail stores, restaurants and the like are commonly constructed with suspended ceilings. These suspended ceiling installations are ubiquitous, owing to their many recognized benefits. Such ceilings ordinarily comprise a rectangular open grid suspended by wire from a superstructure and tile or panels carried by the grid and enclosing the open spaces between the grid elements. The most common form of grid elements has an inverted T-shaped cross-section. The T-shape often includes a hollow bulb at the top of the inverted stem of the T-shape. A popular variant of this standard T-shape includes a downwardly open C-shaped channel formed by the lower part of the inverted tee.

Advances in electronics has fed further advances and lead the world into the digital age. This digital movement creates an ever-increasing demand for low voltage direct current (DC) electrical power. This demand would seem to be at least as great in finished commercial space as any other occupied environment. A conventional suspended ceiling has potential to be an ideal structure for distributing low voltage electrical power in finished space. Many relatively low power devices are now supported on such ceilings and newer electronic devices and appliances are continuously being developed and adopted for mounting on ceilings.

The ceiling structure, of course, typically overlies the entire floor space of an occupiable area. This allows the ceiling to support electronic devices where they are needed in the occupied space. Buildings are becoming more intelligent in energy management of space conditioning, lighting, noise control, security, and other applications. The appliances that provide these features including sensors, actuators, transducers, speakers, cameras, recorders, in general, all utilize low voltage DC power.

As the use of electronics grows, the consumption of low voltage electrical power likewise grows. This seemingly ever accelerating appetite for DC power presents opportunities for more efficient transformation of relatively high voltage utility power typically found at 110/115 or 220/240 alternating current (AC) volts with which the typical enclosed space is provided. Individual power supplies located at the site of or integrated in an electronic device, the most frequent arrangements today, are often quite inefficient in transforming the relatively high voltage AC utility power to a lower DC voltage required by an electronic device. Typically, they can consume appreciable electric power in a standby mode when the associated electronic device is shut off. It is envisioned that a single DC power source serving the electronic needs of a building or a single floor of a building can be designed to be inherently more efficient since its cost is distributed over all of the devices it serves and because it can take advantage of load averaging strategies.

SUMMARY OF THE INVENTION

The invention provides an electrified ceiling constructed of standard metal tees in which adjacent metal grid sections, assembled from such standard tees, are electrically separated from one another and maintained at opposite polarities. The disclosed arrangement permits electrical devices to be mounted on the ceiling and be powered by current flowing directly through the grid tee elements themselves. Electrical devices have their power input terminals each connected directly to a corresponding standard grid tee body held at one or the other electrical polarities.

The inventive scheme is particularly adapted to linear ceiling designs where light strips and other accessories are arranged along a continuous straight line spanning the ceiling. This linear arrangement can be implemented with minimal modification or customization of standard grid elements, and with limited specialized componentry. In the disclosed embodiment, channels for lighting and other accessories are created between sections of standard grid construction. The channels are established with custom brackets in the shape of an inverted U. The brackets serve to precisely hold the adjacent grid sections in parallel, spaced relation and provide clearance for light fixtures and other accessories such as air distributing equipment as well as hanger wire support points for the grid. The bracket or yoke is arranged to be fixed to main tees at the border of respective grid sections of opposite polarity. The bracket electrically isolates the main tees it serves to space by incorporating suitable insulators or being constructed entirely of electrically insulating material.

DESCRIPTION OF THE PREFERRED EMBODIMENT

Figure 1:
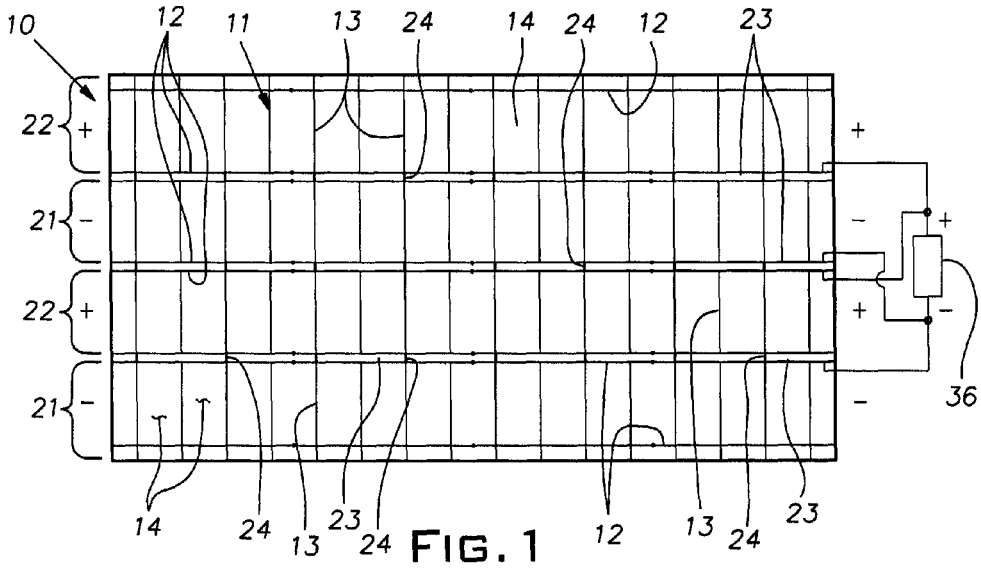
FIG. 1 is a schematic plan view of a suspended ceiling embodying the invention.

FIG. 1 illustrates an example of a suspended ceiling 10 constructed with generally conventional components. The ceiling 10 comprises a rectangular grid system 11 of main runners or tees 12 and cross runners or tees 13 on which are carried ceiling tiles or panels 14. The grid runners or tees are in the form of inverted tees most commonly made of roll-formed sheet steel, galvanized and/or painted for corrosion resistance. The main tees 12 can be 10 or 12 feet long (or metric equivalent), and joined end-to-end to extend the length of the desired ceiling area. U.S. Pat. No. 6,729,100 discloses an example of an end connector suitable for joining the ends of conventional main tees 12. Cross tees 13 are typically 4' or 2' long (or metric equivalent) and are joined end-to-end by connectors such as shown in U.S. Pat. No. 5,761,868. The ceiling panels 14 can be of any known construction either non-metallic and, therefore, non-conducting, or made of metal sheet stock and, therefore conducting.

FIG. 1 illustrates a ceiling grid that is divided in 2' by 4' modules. The main tees 12 have regularly spaced slots along their lengths corresponding to these dimensions. As is customary, connectors at the ends of the cross tees 13 are assembled through main tee slots to establish their proper locations. At the perimeter of the ceiling 10, assuming that it runs wall-to-wall in both the main tee and cross tee directions, is a roll-formed metal wall angle 17 or molding, known in the art. The surfaces of the wall angle 17 in actual or potential contact with the grid tees 12 or 13, are covered with an electrical insulator 18 such as a suitable plastic layer or the wall angle itself can be made entirely of a suitable plastic such as polyvinylchloride (PVC).

Figure 2:
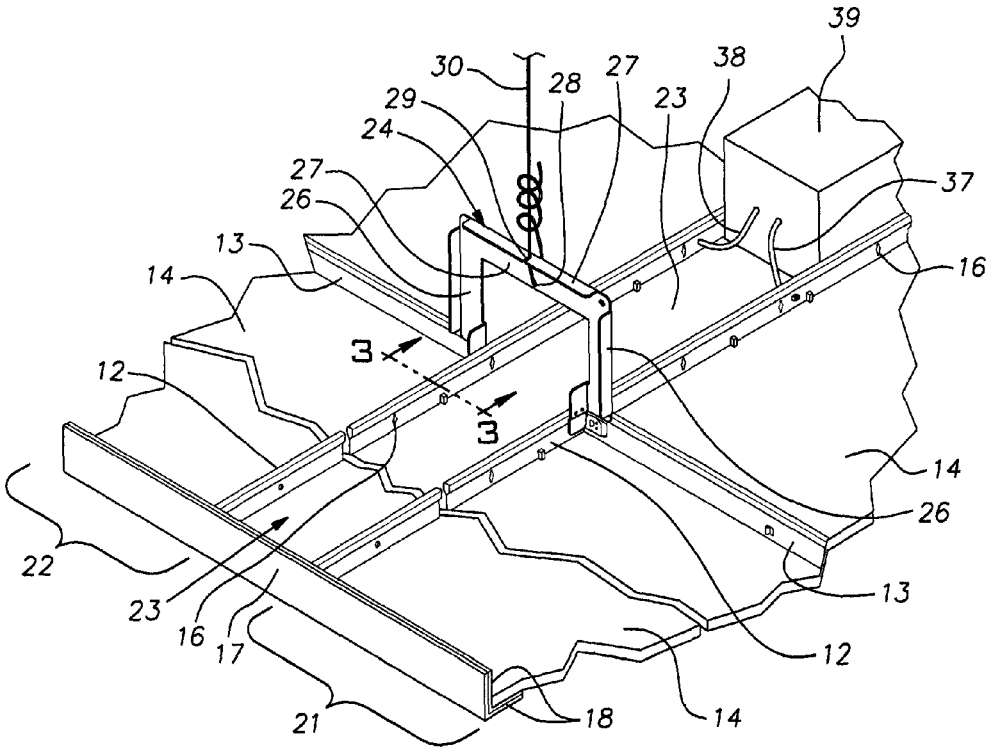
FIG. 2 is a fragmentary isometric view of a portion of the suspended ceiling of FIG. 1 showing adjacent electrically isolated sections of the ceiling.
Figure 3:
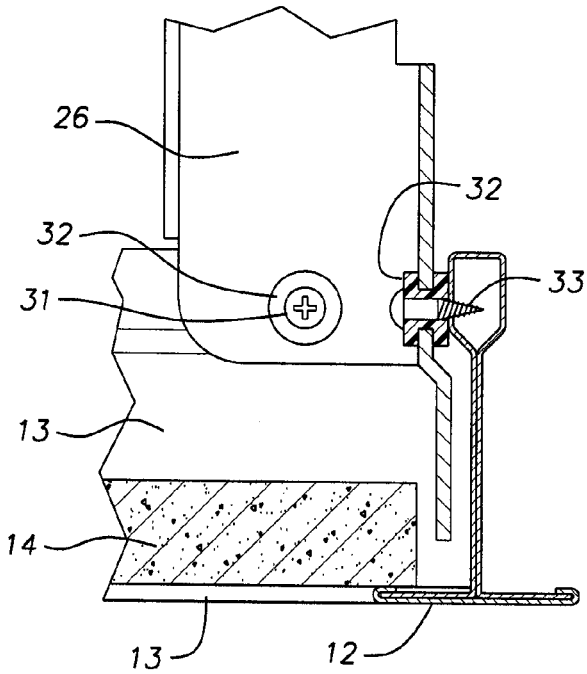
FIG. 3 is a fragmentary elevational view taken at the plane 3-3 indicated in FIG. 2, on an enlarged scale, of an area of a bridge bracket that serves to electrically isolate sections of the ceiling grid.

In the illustrated example, the grid 11 is divided into coplanar sections 21, 22, each comprising a pair of lines of main tees 12 spaced by intervening cross tees 13. Between the grid sections 21, 22 are linear spaces or channels 23 that run lengthwise with the main tees 12. The width of the channels is established by inverted U-shaped brackets or yokes 24. The brackets 24 in the example of FIG. 1 are spaced along the main tees 12 on 4 foot centers. FIGS. 2 and 3 illustrate details of the relationship of a bracket 24 and the main tees 12 of adjacent sections 21, 22. A bracket 24 has a pair of legs 26 that depend from a cross member or bight 27. The vertical length of the legs 26 provides clearance for light fixtures or other accessories such as speakers, air handling ducts, and vents, located in a channel 23 and enables such components to extend under a bracket cross member 27. The center of the bracket cross member 27 has a hole 28 and slot 29 for receiving a suspension wire 30 that supports the bracket 24 and, therefore, the related portion of the ceiling 10 from overhead structure (not shown).

The main tees 12 are fastened to respective bracket legs 26 by screws 31. Electrically insulating grommets 32 are received in holes in the legs 26 and the screws 31, in turn, are received within the grommets. A bracket 24, while being stamped from steel sheet stock does not conduct electricity between the spaced main tees 12 it supports on its legs 26. A power supply 36 diagrammatically illustrated in FIG. 1 electrifies the grid 11 by applying opposite voltage polarities to adjacent sections 21, 22 of the grid 11. This is indicated by the plus and minus signs in FIG. 1. The main tees 12, as mentioned, ordinarily have metal bodies. Low voltage DC power, typically up to 28 volts, for example, can be applied directly to the bodies of the grid tees 12. Where the joints between the ends of the main tees 12 provided by standard end connectors, whether integral with the main tee body or a separate metal clip as disclosed in US-2006-0260246-A1, might not provide a reliable electrical connection, supplemental electrical connectors or jumpers may be provided to assure electrical connection between the ends of joined tees. Similar expedients can be used, where desired, to make certain that electrical conduction between the cross tees 13 of a particular grid section 21 or 22 and their respective main tees 12 is established.

There is no need to supply separate conductors on or along the lengths of the tees 12 since the tees themselves are electrified. Moreover, there is no concern to electrically isolate the main tees 12 or cross tees 13 of a particular section 21 or 22 from one another. As shown in FIG. 2, power can be taken from the adjacent main tees 12 on opposite sides of a channel 23 anywhere along the channel by simply connecting leads 37, 38 of an electrical device 39 directly to these main tees.

Figure 4:
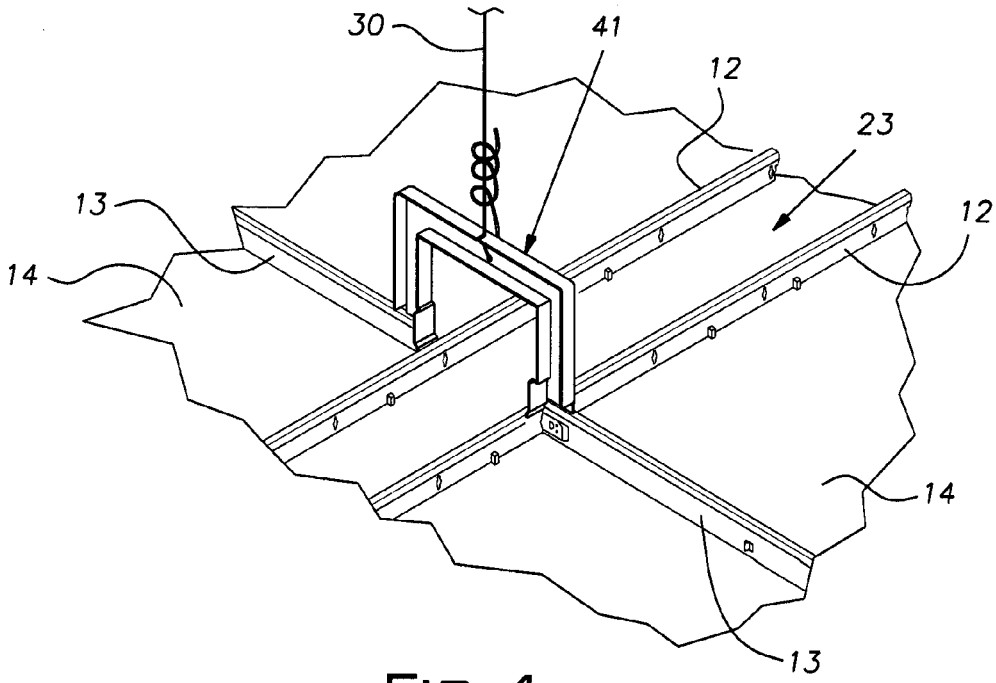
FIG. 4 illustrates a variant of the bridge bracket capable of electrically isolating adjacent sections of the ceiling grid.

FIG. 4 illustrates a modified bridge or bracket 41 that can be substituted for the bracket 24. The bracket or yoke 41 is formed by injection molding a suitable material such as a composite thermosetting plastic material with suitable fillers and/or reinforcing fibers.

From the foregoing, it will be seen that standard metal grid tees 12, 13 can be used and be directly electrically energized without supplemental conductors to provide electrical power to ceiling mounted devices or appliances 39. These appliances 39 are conveniently disposed in the linear channel 23 separating the electrified grid sections 21, 22. Other known forms of metal grid tees can be used such as the lower, open slot style and extruded aluminum versions. A grid section can involve more than one row of modules, i.e. a section can comprise three or more parallel lines of main tees.

Where the grid sections are expansive or for other reasons, there may be a need to use additional suspension wires at locations other than at the brackets 24, 41 or their equivalents. These additional suspension wires can each be electrically insulated such as by slipping an insulating sleeve of a suitable plastic over the portion of the wire looped through a hole in a grid tee.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An electrified grid for a suspended ceiling comprising first and second grid sections lying in a common ceiling plane, each grid section having metal body main tees and metal body cross tees intersecting with the main tees, the first and second sections being adjacent one another and having respective main tees in parallel alignment and with a fixed spacing substantially smaller than the length of the cross tees, the grid sections being electrically insulated from one another whereby at least said bodies of said main tees of fixed spacing can be held at opposite voltage polarities and an electrical device carried on or above the ceiling can be powered by electrical connection of separate ones of its leads to the body of the metal tees of a respective one of said first and second grid sections.

2. An electrified grid as set forth in claim 1, wherein the spacing between said sections extends substantially fully across one dimension of said grid.

3. An electrified grid as set forth in claim 1, including more than two electrically insulated sections and at least two fixed spacings.

4. An electrified grid as set forth in claim 1, wherein an electrically operated fixture is disposed in said fixed spacing and is electrically powered by connecting each of its leads to a respective one of said sections.

5. An electrified grid as set forth in claim 1, having a perimeter formed by a wall angle, said wall angle being electrically insulated from main and cross tees to avoid short circuiting of the voltage applied to said tees of opposite polarity.

6. An electrified grid as set forth in claim 1, including a DC power supply of limited voltage having its outputs separately electrically connected to a respective one of said grid sections.

7. An electrified grid as set forth in claim 1, including a plurality of U-shaped brackets spaced longitudinally of said main tees, said brackets being fixed to said main tees and being arranged to be supported by overhead suspension wires.

8. An electrified grid as set forth in claim 7, wherein said brackets have electrical insulating properties enabling them to be screwed to said tees of both of said sections while avoiding short circuiting of said sections together.

* * * * *